US005487837A

United States Patent [19]

Ozaki et al.

[11] Patent Number: 5,487,837

[45] Date of Patent: Jan. 30, 1996

[54] GREASE COMPOSITION FOR CONSTANT VELOCITY JOINT

[75] Inventors: Takahiro Ozaki; Tomoo Munakata; Fumio Goto; Tetsuo Tsuchiya, all of Tokyo, Japan

[73] Assignee: Showa Shell Sekiyu K. K., Tokyo, Japan

[21] Appl. No.: 366,119

[22] Filed: Dec. 29, 1994

[30] Foreign Application Priority Data

Dec. 29, 1993 [JP] Japan ..... 5-353700

[51] Int. Cl.[6] ..... C10M 141/02; C10M 141/06

[52] U.S. Cl. ..... 252/25; 252/32.7 E; 252/33.6; 252/40.7; 252/46.6

[58] Field of Search ..... 252/25, 32.7 E, 252/40.7, 33.6, 46.6, 51.5 A

[56] References Cited

U.S. PATENT DOCUMENTS

| | | | |
|---|---|---|---|
| 3,361,665 | 1/1968 | Tesche et al. | 252/25 |
| 4,107,058 | 8/1978 | Clarke et al. | 252/18 |
| 4,514,312 | 4/1985 | Root et al. | 252/32.5 |
| 4,787,992 | 11/1988 | Waynick | 252/18 |
| 4,830,767 | 5/1989 | Waynick | 252/25 |
| 4,840,740 | 6/1989 | Sato et al. | 252/32.7 |
| 4,902,435 | 2/1990 | Waynick | 252/18 |
| 5,084,193 | 1/1992 | Waynick | 252/18 |
| 5,160,645 | 11/1992 | Okaniwa et al. | 252/32.7 |
| 5,207,936 | 5/1993 | Anzai et al. | 252/25 |

FOREIGN PATENT DOCUMENTS

| | | | |
|---|---|---|---|
| 023375 | 8/1987 | European Pat. Off. | C10M 169/06 |
| 2185492 | 7/1987 | United Kingdom | C10M 135/12 |
| 2255346 | 11/1992 | United Kingdom | C10M 169/06 |

OTHER PUBLICATIONS

Database WPI, Section Ch, Week 8813, Derwent Publications, Ltd., London, GB; Class A17, AN 88–088512 for JP–A–63 039 989 (Showa Shell Sekiyu KK) 20 Feb. 1988.

*Primary Examiner*—Margaret Medley

*Attorney, Agent, or Firm*—Sughrue, Mion, Zinn, Macpeak & Seas

[57] ABSTRACT

A grease composition comprising a grease containing, in a base oil thereof, from 2 to 40% by weight, based on the total composition, of tricalcium phosphate [$Ca_3(PO_4)_2$], the grease further containing (A) from 0.5 to 10% by weight, based on the total composition, of a molybdenum dialkyldithiocarbamate sulfide and (B) from 0.1 to 5% by weight, based on the total composition, of at least one of a zinc dialkyldithiophosphate and triphenyl phosphorothionate. The grease composition is excellent in mechanical stability, heat resistance, extreme pressure properties, and wear resistance.

1 Claim, No Drawings

GREASE COMPOSITION FOR CONSTANT VELOCITY JOINT

FIELD OF THE INVENTION

This invention relates to a grease composition used at a sliding part of constant velocity joint (CVJ) of automobiles, that is, fixed joints and plunging joints.

BACKGROUND OF THE INVENTION

In the field of automobile industry, the tendency to size reduction and weight reduction has been strengthened. Further, front wheel front drive (FF) cars show a world-wide tendency to increase partly because of the demand for sufficient elbow room.

CVJ has been widely spreading also in Japan with model changes and the increase of independent rear suspension drive shafts (FR) cars. In FF cars, a fixed CVJ and a plunging CVJ are used in combination generally with the former outboard and the latter inboard. In FR cars, a plunging CVJ is often used both outboard and inboard.

A fixed CVJ tends to increase in temperature with an increase in angle, a reduction in size and weight or an increase in engine output. A plunging CVJ, which is used inboard, suffers from a temperature rise because the cooling effect during running hardly reaches and also because heat from differential gears is transmitted. A plunging CVJ is accompanied by reciprocal rolling and sliding on revolution and, as a result, resistance in the axial direction is apt to occur. The thus induced thrust has great influences on vibration of an automatic car body during idling, a shudder of a car body at the start and acceleration, and generation of beating noise or booming noise and vibration of a car body at a middle to high speed.

In order to reduce the induced thrust force, studies have been directed to improvements in structure and material of CVJ itself and improvements of lubricating grease to be applied to a joint.

High performance lubricating grease functions to suppress friction and wear of the sliding part of CVJ thereby serving for improvement in durability and reduction in vibration. Therefore, a high-temperature grease which exhibits improved extreme pressure properties and improved wear resistance and also withstands the above-mentioned elevated temperature of CVJ has been keenly demanded.

Under these circumstances, various lubricants for CVJ have been proposed to date. The most common of them is a grease composition comprising a purified mineral oil as a base oil and a lithium soap as a thickening agent. The grease of this kind usually contains additives for imparting extreme pressure properties, wear resistance, and friction inhibitory action, such as molybdenum disulfide, sulfurized fats and oils, and olefin sulfides. Recently, the use of a grease containing a calcium complex soap or urea which is more heat-resistant than a lithium soap as a thickening agent has been extending.

Typical examples of known grease compositions which seem relevant to that of the present invention will be mentioned below. U.S. Pat. No. 4,787,992 discloses a calcium soap-thickened front wheel drive grease, in which a thickening agent comprising a calcium soap or a calcium complex soap is used in combination with other additives, such as tricalcium phosphate and calcium carbonate, to impart extreme pressure properties to the base grease. U.S. Pat. No. 4,514,312 describes a grease composition comprising a urea grease having incorporated thereto an organomolybdenum compound and zinc dithiophosphate as additives. JP-A-4-304300 (the term "JP-A" as used herein means an "unexamined published Japanese patent application") discloses a urea grease composition essentially containing prescribed amounts of a molybdenum dialkyldithiocarbamate sulfide, molybdenum disulfide, a zinc dithiophosphate compound, and one or more of oiliness improvers. JP-A-4-279698 discloses a grease composition for CVJ containing powdered boron nitride and an organozinc compound, such as zinc dithiophosphate.

However, the conventional grease involved any of disadvantages, such as insufficient performance in extreme pressure properties and wear resistance, tendency to induction of thrust force, and softening in high temperatures.

SUMMARY OF THE INVENTION

An object of the present invention is to provide a grease composition for CVJ which is excellent in mechanical stability, heat resistance, extreme pressure properties, and wear resistance.

The present invention relates to a grease composition comprising a grease containing, in a base oil thereof, from 2 to 40% by weight, based on the total composition, of tricalcium phosphate [$Ca_3(PO_4)_2$], the grease further containing (A) from 0.5 to 10% by weight, based on the total composition, of a molybdenum dialkyldithiocarbamate sulfide represented by formula (I):

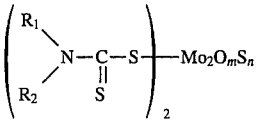

(I)

wherein $R_1$ and $R_2$ each represent an alkyl group having 1 to 24 carbon atoms; m represents an integer of 0 to 3; and n represents an integer of 1 to 4; provided that the sum of m and n is 4;

and (B) from 0.1 to 5% by weight, based on the total composition, of at least one of (B-1) a zinc dialkyldithiophosphate represented by formula (II):

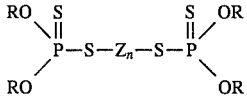

(II)

wherein R represents a primary or secondary alkyl group (preferably having 3 to 8 carbon atoms);

and (B-2) triphenyl phosphorothionate represented by formula (III):

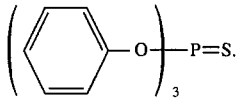

(III)

DETAILED DESCRIPTION OF THE INVENTION

The molybdenum dialkyldithiocarbamate sulfide as component (A) includes molybdenum diethyldithiocarbamate sulfide, molybdenum dibutyldithiocarbamate sulfide, molybdenum diisobutyldithiocarbamate sulfide, molybdenum di(2-ethylhexyl)dithiocarbamate sulfide, molybdenum diamyldithiocarbamate sulfide, molybdenum diisoamyldithiocarbamate sulfide, molybdenum dilauryldithiocarbamate sulfide, and molybdenum distearyldithiocarbamate sulfide.

Component (A) is used in an amount of from 0.5 to 10% by weight, preferably from 0.5 to 5% by weight, based on the total composition. If the proportion of component (A) is less than 0.5%, no effects is produced on improvement of extreme pressure properties and wear resistance. Even if it exceeds 10%, no further improvement is obtained.

The zinc dialkyldithiophosphate and/or triphenyl phosphorothionate as component (B) is/are used in a total amount of from 0.1 to 5% by weight, preferably from 0.3 to 2% by weight, based on the total composition. If the proportion of component (B) is less than 0.1%, significant improvement in extreme pressure properties or wear resistance cannot be obtained. If it is more than 5%, the grease composition is liable to be softened to lose its lubricating action when used under shearing in high temperatures.

If desired, the grease composition of the present invention may contain additives, such as antioxidants, rust inhibitors, extreme pressure additives, polymers, and the like conventional additives.

The present invention will now be illustrated in greater detail by way of Examples, but it should be understood that the present invention is not to be construed as being limited thereto. All the percents are given by weight unless otherwise indicated.

EXAMPLES 1 TO 11 AND COMPARATIVE EXAMPLES 1 TO 11

Formulations of grease compositions according to the present invention are shown in Table 1, which comprised a base oil, tricalcium phosphate as a thickening agent, and, as additives, a molybdenum dialkyldithiocarbamate sulfide (hereinafter abbreviated as Mo-DTC) and at least one of a zinc dialkyldithiophosphate (hereinafter abbreviated as Zn-DTP) and triphenyl phosphorothionate (hereinafter abbreviated as TPPT). The base oil used was a purified mineral oil having a viscosity of 15 $mm^2$/sec at 100° C. or a poly-α-olefin oil having a viscosity of 20 $mm^2$/sec at 100° C.

In Table 2 are shown formulations of comparative grease compositions comprising a base grease and additives. The base grease used in comparative grease compositions had the following composition. The base oil used in the base grease is the same as used in the grease compositions of Examples.

I. Urea Grease

Two moles of tolylene diisocyanate (2,4-tolylene diisocyanate: 65%; 2,6-tolylene diisocyanate: 35%), 2 mol of stearylamine, and 1 mol of ethylenediamine were reacted in a base oil, and the urea compound produced was uniformly dispersed to obtain a grease. The content of the urea compound in the total grease composition was adjusted to 20%.

II. Lithium Soap Grease

Lithium 12-hydroxystearate was dissolved and uniformly dispersed in a base oil to obtain a lithium soap grease. The soap content in the total grease composition was adjusted to 9%.

III. Aluminum Complex Soap Grease

Benzoic acid and stearic acid were dissolved in a base oil, and a commercially available cyclic aluminum oxide propylate lubricant Algomer, produced by Kawaken Fine Chemical K.K., was added thereto to allow the mixture to react. The resulting soap was uniformly dispersed to obtain a grease. The soap content in the total grease composition was adjusted to 11%. The molar ratio of benzoic acid (BA) to stearic acid (SA), BA/FA, was 1.1, and the molar ratio of the sum of benzoic acid and stearic acid to aluminum (Al), (BA+FA)/Al, was 1.9.

All the grease compositions were prepared by means of a three-roll mill.

Each of the grease compositions prepared was evaluated for mechanical stability, extreme pressure properties, and wear resistance in accordance with the following test methods. The results obtained are shown in Tables 1 and 2.

1) Heat Resistance

Measured according to the dropping point test method specified in JIS K2220. A "dropping point", an indication of heat resistance, is a heating temperature at which a grease in a prescribed container begins to drip on being heated under prescribed conditions.

2) Mechanical Stability

Mechanical stability was evaluated by measuring an unworked penetration and a worked penetration (60 strokes) at 25° C. Mechanical stability was also evaluated by Shell roll test (ASTM 1831), in which penetration of a grease is measured after being sheared between a cylinder and a roller at room temperature or 100° C. for 24 hours. The higher penetration in the Shell roll test means the softer grease by shearing.

3) Extreme Pressure Properties and Wear Resistance

Shell four-ball EP test was carried out according to ASTM D2596, in which a load imposed is gradually raised from low to high until welding occurs, and the average wear scar diameter (mm) of the fixed balls is measured to obtain a last non-seizure load, a weld load, and a load-wear index. The higher these values mean the higher extreme pressure property in the test method.

TABLE 1

| | Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| Composition (wt %): | | | | | | | | | | | |
| Mineral oil | 72 | 71 | 71 | 70.5 | 70 | 69 | 69 | | | 81 | 66 |
| Poly-α-olefin oil | | | | | | | | 71 | 70 | | |
| $Ca_3(PO_4)_2$ | 25 | 25 | 25 | 25 | 25 | 25 | 25 | 25 | 25 | 15 | 30 |
| Mo-DTC (*1) | 3 | 3 | 3 | 3 | 3 | 5 | 5 | 3 | 3 | 3 | 3 |
| Zn-DTP (*2) | | 1 | | 1 | | 1 | | 1 | | 0.5 | 1 |
| TPPT (*3) | | | 1 | 0.5 | 2 | | 1 | | 2 | 0.5 | |
| Test Results: | | | | | | | | | | | |

TABLE 1-continued

| | Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| Penetration (25° C.): | | | | | | | | | | | |
| Unworked | 277 | 321 | 282 | 314 | 293 | 303 | 268 | 339 | 314 | 377 | 242 |
| Worked (60 strokes) | 277 | 327 | 282 | 326 | 291 | 308 | 275 | 342 | 310 | 380 | 242 |
| Dropping Point (°C.): | 263 | >270 | >270 | >270 | >270 | >270 | >270 | >270 | >270 | >270 | >270 |
| Shell Roll Test: | | | | | | | | | | | |
| Room temp. × 24 hrs (worked penetration, 60 strokes) | 275 | 349 | 285 | 354 | 253 | 336 | 279 | 345 | 315 | 398 | 235 |
| 100° C. × 24 hrs (worked penetration, 60 strokes) | 330 | 388 | 330 | 390 | 329 | 363 | 292 | 382 | 376 | — | 220 |
| Shell 4 Ball EP Test: | | | | | | | | | | | |
| Last Non-Seizure Load (kgf) | 126 | 126 | 100 | 126 | 126 | 126 | 160 | 100 | 160 | 100 | 160 |
| Weld Load (kgf) | 315 | 315 | 315 | 315 | 315 | 400 | 400 | 315 | 315 | 250 | 400 |
| Load-Wear Index (kgf) | 60 | 58 | 58 | 59 | 60 | 65 | 74 | 57 | 67 | 49 | 73 |

TABLE 2

| | Comparative Example No. | | | | | | | | | | |
|---|---|---|---|---|---|---|---|---|---|---|---|
| | 1 | 2 | 3 | 4 | 5 | 6 | 7 | 8 | 9 | 10 | 11 |
| Composition (wt %): | | | | | | | | | | | |
| Urea grease | 97 | 97 | 95 | 95 | 95 | | | | | | |
| Lithium soap grease | | | | | | 95 | 98 | 97 | | | |
| Aluminum complex soap grease | | | | | | | | | 97 | 97 | 95 |
| Mo-DTC (*1) | 3 | | 3 | | 3 | | | | 3 | | 3 |
| Mo-DTP (*4) | | 3 | | 3 | 1 | | | 3 | | | |
| Zn-DTP (*2) | | | 2 | 2 | 1 | | 2 | | | | 2 |
| Lead naphthenate (*5) | | | | | | 2 | | | | | |
| Olefin sulfide (*6) | | | | | | | | | | 3 | |
| Sulfurized fats and oils (*7) | | | | | | 3 | | | | | |
| Test Results: | | | | | | | | | | | |
| Penetration (25° C.): | | | | | | | | | | | |
| Unworked | 263 | 305 | 285 | 308 | 279 | 246 | 240 | 241 | 269 | 272 | 262 |
| Worked (60 strokes) | 269 | 306 | 296 | 316 | 293 | 256 | 244 | 243 | 264 | 285 | 257 |
| Dropping Point (°C.): | 248 | 255 | 252 | 254 | 252 | 194 | 199 | 199 | >270 | >270 | >270 |
| Shell Roll Test: | | | | | | | | | | | |
| Room temp. × 24 hrs (worked penetration, 60 strokes) | 341 | 371 | 359 | 363 | 355 | 346 | 335 | 398 | 313 | 320 | 312 |
| 100° C. × 24 hrs (worked penetration, 60 strokes) | 370 | 404 | 382 | 378 | 364 | >440 | >440 | >440 | 234 | 289 | 234 |
| Shell Four-Ball EP Test: | | | | | | | | | | | |
| Last Non-Seizure Load (kgf) | 80 | 80 | 100 | 100 | 80 | 50 | 80 | 50 | 50 | 50 | 63 |
| Weld Load (kgf) | 250 | 200 | 250 | 250 | 250 | 315 | 250 | 250 | 250 | 315 | 315 |
| Load-Wear Index (kgf) | 38 | 35 | 46 | 45 | 40 | 41 | 37 | 28 | 33 | 49 | 40 |

Note:
*1: Sakuralube 600, produced by Asahi Denka Kogyo K.K.
*2: Lubrizol 1360, produced by Lubrizol K.K.
*3: Irgalube TPPT, produced by Ciba Geigy AG.
*4: Sakuralube 300, produced by Asahi Denka Kogyo K.K.
*5: Dailube L-30, produced by Dainippon Ink and Chemicals, Inc.
*6: Lubrizol 5340, produced by Luberizol K.K.
*7: Dailube S-265, produced by Dainippon Ink and Chemicals, Inc.

As is apparent from Tables 1 and 2, the grease compositions of the present invention and the urea grease compositions of Comparative Examples 1 to 5 are not so different in data of the Shell roll test, whereas great differences are observed therebetween in the Shell four-ball EP test, proving the superiority of the present invention.

On comparing the data of Examples of the present invention with those of the lithium grease compositions of Comparative Examples 6 to 8, the latter compositions had a penetration exceeding 400 as measured by a Shell roll test (100° C.), failing to retain the grease state. Further, the last non-seizure load and load-wear index of these comparative grease compositions are lower than those of the grease compositions of the present invention, turning to be inferior in heat resistance and extreme pressure properties to the grease compositions of the present invention.

On comparing the data of the grease compositions according to the present invention with those of the aluminum complex soap grease compositions of Comparative Examples 9 to 11, it is seen that the latter compositions are comparable to the former compositions as far as dropping point and weld load in Shell four-ball EP test are concerned but have a lower last non-seizure load and a lower load-wear index, proving inferior in extreme pressure properties.

As described and demonstrated above, the grease composition for CVJ according to the present invention exhibits markedly excellent lubricating performance in terms of, for example, last non-seizure load, weld load, and load-wear index, as compared with conventional ones.

While the invention has been described in detail and with reference to specific examples thereof, it will be apparent to one skilled in the art that various changes and modifications can be made therein without departing from the spirit and scope thereof.

What is claimed is:

1. A grease composition consisting essentially of a grease containing, in a base oil thereof, from 2 to 40% by weight, based on the total composition, of tricalcium phosphate $Ca_3(PO_4)_2$], the grease further containing (A) from 0.5 to 10% by weight, based on the total composition, of a molybdenum dialkyldithiocarbamate sulfide represented by formula (I):

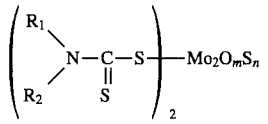

(I)

wherein $R_1$ and $R_2$ each represent an alkyl group having 1 to 24 carbon atoms; m represents an integer of 0 to 3; and n represents an integer of 1 to 4; provided that the sum of m and n is 4;

and (B) from 0.1 to 5% by weight, based on the total composition, of at least one of (B-1) a zinc dialkyldithiophosphate represented by formula (II):

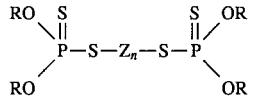

(II)

wherein R represents a primary or secondary alkyl group; and (B-2) triphenyl phosphorothionate represented by formula (III)

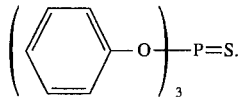

(III)

* * * * *